United States Patent [19]

Rumpf et al.

[11] 4,132,634

[45] Jan. 2, 1979

[54] METHOD OF AN APPARATUS FOR SIFTING PARTICULATE MATERIAL IN A CROSS-CURRENT

[75] Inventors: Hans Rumpf, Hansjakobstr. 12, 75 Karlsruhe, Kurt Leschonski, Clausthal-Zellerfeld, both of Fed. Rep. of Germany

[73] Assignee: Hans Rumpf, Karlsruhe, Fed. Rep. of Germany

[21] Appl. No.: 810,749

[22] Filed: Jun. 28, 1977

Related U.S. Application Data

[63] Continuation of Ser. No. 613,490, Sep. 15, 1975, abandoned.

[30] Foreign Application Priority Data

Sep. 17, 1974 [DE] Fed. Rep. of Germany ..... 2444378

[51] Int. Cl.[2] ..... B07B 4/00

[52] U.S. Cl. ..... 209/136; 209/138; 209/144; 209/145

[58] Field of Search ..... 209/132–139 A, 209/143, 145, 142, 147, 148, 154, 120, 153

[56] References Cited

U.S. PATENT DOCUMENTS

| | | | |
|---|---|---|---|
| 3,006,470 | 10/1961 | Franken | 209/132 |
| 3,311,234 | 3/1967 | Rumpf et al. | 209/139 R X |
| 3,315,806 | 4/1967 | Sigwart et al. | 209/143 |
| 3,520,407 | 7/1970 | Rumpf et al. | 209/139 R |

FOREIGN PATENT DOCUMENTS

| | | | |
|---|---|---|---|
| 127934 | 4/1932 | Austria | 209/142 |

*Primary Examiner*—Frank W. Lutter
*Assistant Examiner*—Ralph J. Hill
*Attorney, Agent, or Firm*—Kenyon & Kenyon Reilly Carr & Chapin

[57] ABSTRACT

In a method and apparatus for sifting particulate material in a cross current, the method and apparatus being of the type wherein all particles of the same size are propelled transversely at the same velocity of at least approximately 5 m/sec and with the same direction in a thin layer into a high velocity sifting gas current so as to preclude a determinative influence of gravity, the particles spread out into the current and after a time of flight of the order of magnitude of 1/100 second separated into two or more fractions by one or more knife edges disposed in a direction opposite to the material trajectories without previously rebounding from any wall, and the incoming sifting gas flow subdivided into at least two parts which are led off separately, improved separation characteristics are obtained by establishing an additional partial flow which is led off in a direction different from the influx direction of the sifting gas current, the partial flow having a momentum component in a direction opposite to the direction in which material is propelled into the sifting gas current which has a value which is at least 1/10 that of the momentum of the current of material being propelled into the sifting gas current.

21 Claims, 8 Drawing Figures

FIG. 2
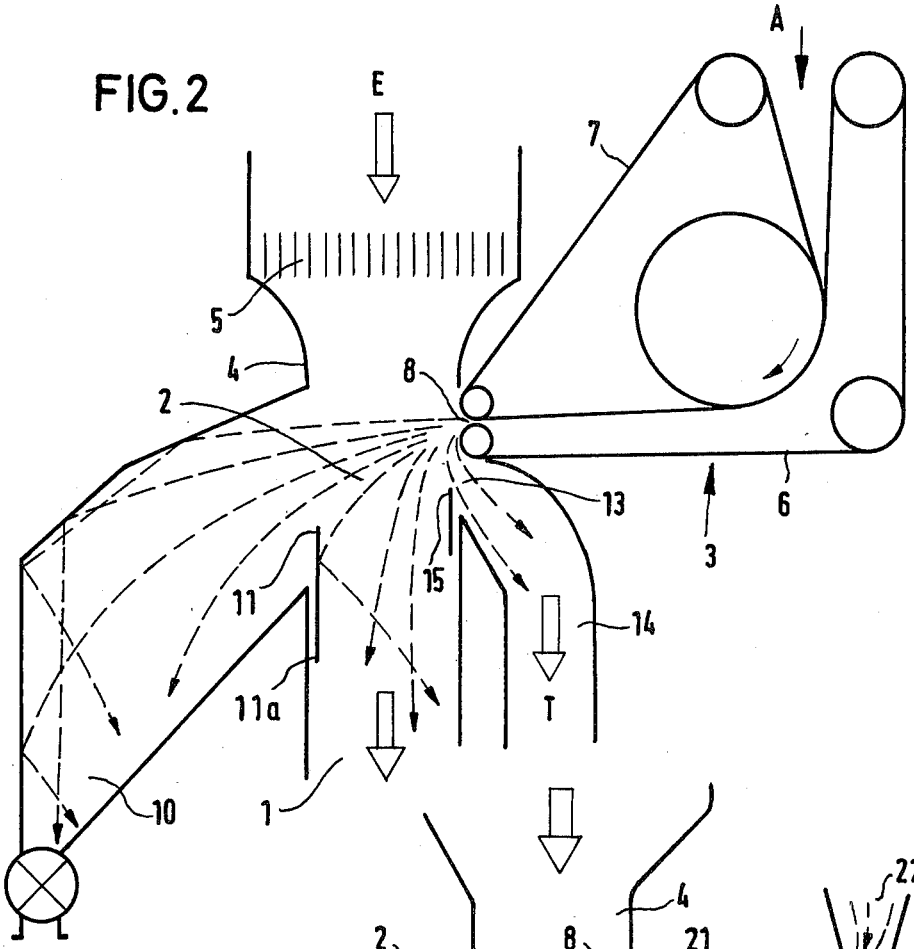
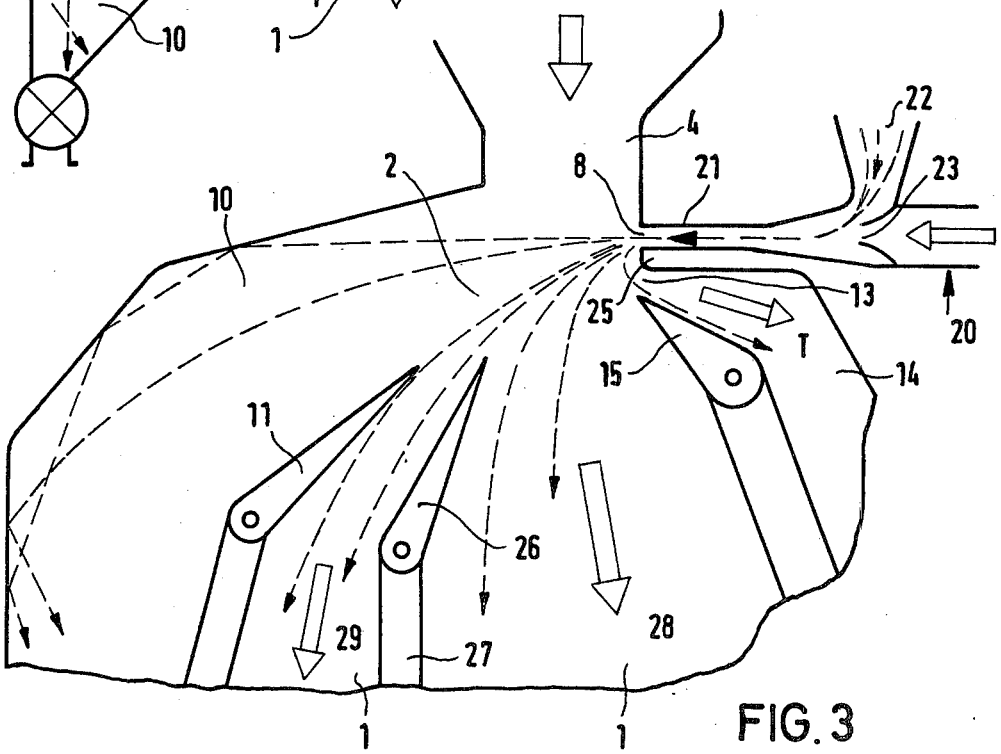
FIG. 3

METHOD OF AN APPARATUS FOR SIFTING PARTICULATE MATERIAL IN A CROSS-CURRENT

This is a continuation of application Ser. No. 613,490 filed Sept. 15, 1975, now abandoned.

BACKGROUND OF THE INVENTION

The invention concerns a method of sifting particulate material in a cross-current at cut sizes considerably below 1 mm, and apparatus for carrying out cross-current sifting with a high throughput and satisfactory sharpness of separation of very fine powders. It concerns more particularly a further development and improvement of the cross-current methods and apparatus, described in U.S. Pat. Nos. 3,311,234 and 3,520,407 and in German Pat. Nos. 1,507,736 and 1,607,656 as known from Applicant's German Patent Specification No. 1,482,458 (corresponding U.S. Patent Specification No. 3,311,234); 1,507,735 (corresponding U.S. Patent Specification No. 3,520,407); and 1,507,736 and 1,607,656.

In these known cross-current air sifting methods of separating particulate material into two or more fractions, all particles of the same size and charged i.e. propelled with the same velocity of at least 5 m/sec in the same direction in a thin layer transversely into a sifting gas current of high velocity, precluding any decisive influence of gravity, are spread out in the current and after a time of flight of the order of magnitude of 1/100 sec are separated into two or more fractions by one or more knife edges opposing the particles trajectories without previous impingement on any wall. While the fine material is entrained by the sifting gas current into a flow duct, the coarse material passes over the knife edge into a coarse material collecting receptacle. The sifting-gas current may be plane as disclosed in U.S. Pat. No. 3,311,234, so that all particles of the material enter in a thin plane layer into a plane flow, whose flow planes, agreeing with the movement planes of the particles, possess congruent velocity fields, the flow velocity of the sifting-gas current being at least 20 m/sec in order to preclude the influence of gravity. The sifting gas current on the coarse material output side, opposite the material input side, has a free jet boundary through which the coarse particles enter a coarse material collecting receptacle. The sifting gas current entraining the fine particles can be divided at particle track surfaces into at least two fractions, from which the fine particles can be separately exhausted from one or the other fraction. At the same time, the oncoming sifting gas current, downstream of the material inlet point, can be divided into at least two partial currents which are charged in each case with fine or very fine material and which are initially led off separately at a distance from the material inlet parallel to the inlet flow direction. The sifting gas current may, however, also have an axially-symmetrical annular cross-section, into which the particles are introduced from the inside in a thin layer by means of a centrifugal plate as described in U.S. Pat. No. 3,520,407.

Sifting may be carried out in each case under pressure or suction, i.e. a blower producing the sifting gas current may force the sifting gas into the sifting zone, or exhaust it from the said zone.

In a cross-stream i.e. a cross current or transverse sifter for carrying out the plane sifting process, the material is fed by a conveyor into a sifting gas current carried before and after the sifting zone in a flow duct. The duct walls are interrupted in the region of the material inlet and the coarse material outlet is situated inlet. The discharge roller of a conveyor belt feeder is located outside the flow duct. The sifting gas current enters the sifting zone through a nozzle immediately in front of the material inlet with the same velocity over its entire cross section. A flow straightener may be provided preceeding the nozzle. The sifting zone includes an adjustable knife edge facing the flow at the coarse material outlet which forms the boundary of the sifting zone. The conveyor belt for introducing the material, on the side running towards the material inlet, may be covered over the entire belt width or preferably over the middle part of the belt width by another conveyor belt moving at the same speed and spaced, at the most, at a slight distance above it. The known cross-current sifter for carrying out the axially-symmetrical cross-current sifting method has a stationary flow duct for sifting gas charged with fine material, a centrifugal plate situated at the duct inlet and co-axial with it, a coarse-material collecting receptacle surrounding the duct, and a sifting gas annular nozzle, preceding the centrifugal plate and flow duct co-axially with axial spacing and tapering in the direction of flow towards the inlet orifice. The side of the centrifugal plate contacted by the sifted material has, at least in the radially outer region, the shape of a concave-conical or concave-curved surface of revolution. It is covered at a slight distance by a cover extending to the outer edge of the plate. The external diameter of the centrifugal plate is almost equal to or smaller than the inner diameter of the flow duct. The inlet for the coarse material projected by the centrifugal plate into the coarse material collecting receptacle is coaxial with the duct inlet. Its diameter is no larger than the external diameter of the duct inlet. The annular nozzle for the sifting gas may be preceded by a flow straightener. The sifting gas current passes outside the external diameter of the centrifugal plate. The sifting gas current has along the periphery of the nozzle outlet an equally high velocity and at the nozzle outlet is directed parallel to the axis of the flow duct into the duct inlet. On the flow-duct outer wall facing the nozzle is an axially slidable cylindrical knife edge which limits the sifting zone and over which the coarse material passes into the coarse material collecting receptacle. The inner wall of the flow duct extends cylindrically in the direction of the sifting gas flow at the outlet from the sifting gas nozzle.

The present invention is based on this cross-current sifting method and apparatus. It is thus to be differentiated from all separated methods and devices in which gravity plays a part. This will be seen from the following table which for material particles of density 1 g/cm$^3$ gives the distance of fall in air in 1/100 sec.

| Material particle diameter | 10 | 30 | 50 | 100 | 300 | >300μ |
|---|---|---|---|---|---|---|
| Distance of fall in 1/100 sec. | 0.03 | 0.3 | 0.33 | 0.43 | 0.5 | 0.5 mm |

Above 300μ, the distance of fall in 1/100 sec is as yet unaffected by air friction and amounts to 0.5 g $t^2$ = 0.5 mm, and at 3/100 sec to 4.5 mm. Owing to gravity, therefore, the dispersion range of any particle distribution is only 0.5 mm or at 3/100 sec, which may be regarded as the upper limit of the time of flight for the cross-current method of separation of the present type, only 4.5 mm. In such a case no technical wind sifting is possible. In the case of a method of this type, gravity is actually without influence. The dispersion of the material is affected only the the sifting gas flow. Separation is thus independent of the absolute direction of movement of the material and the sifting gas flow in space, but on how the flow is directed with respects to the input of material and how high the velocity contributions are. In principle, the input of material may be from above downward, from below upward, horizontally or obliquely. The length of each material trajectory from input to the knife edge at 1/100 sec time of flight and with a 10 m/sec input velocity is 10 cm, at 20 m/sec input velocity it is 5 cm, at 2/100 sec and 10 m/sec input velocity, it is 20 cm. Much longer flight paths, i.e. more than 0.5 m, could be desirable, but are scarcely compatible with cross-current wind sifting of this type.

Cross-current sifting of this type thus differs unmistakably from the known whirlwind e.g. cyclone and the like sifting methods, in which the material is projected from a rotating plate into an ascending current and the fine material is carried out at the top, while the coarse material descends. In such methods, gravity is always largely involved. Insofar as applies to the separation, the sifters are not cross-current wind sifters but countercurrent equlibrium wind sifters with gravity separation. Furthermore, in these known whirlwind air sifters, the sifting zone extends as far as the cylindrical boundary wall of the ascending sifting currents that is to say, to the flow duct wall. If the coarsest material is not previously sedimented out and the finest material is entrained upwardly by the current, the material strikes against the wall and is then subjected to renewed separating conditions. In all commercially important whirlwind air sifters, a rotating flow component is superimposed on the ascending air flow. The scattering plate then mainly has the function of distributing the material in the ascending air flow. It does not yet determine even the velocity of the material essential for separation. On the contrary, this is effected by the centrifugal force in the rotating flow. In this, method the processes taking place directly on the flow-duct wall, for example the rotary impulse exchange and secondary air flow occurring there have a substantial influence on the separating effect. In these whirlwind sifters, therefore, the zone of separation extends as far as the cylindrical duct wall which in commercial sifters of over 2m in diameter is far more than 0.5 m from the rotating feed plate circumference. It extends farther down, where the air flows opposite to the decending coarse material, and often extends by much more than 1 m upwardly, where centrifugal sifting of the material in the ascending flow continues. In centrifugal wind sifters, the ascending flow often receives an inwardly directed flow component, so that centerflow equilibrium sifting is produced for sifting out the fine material from the coarser sprayed particles.

In the cross-current type of sifting method, on the contrary, separation is effected as a cross-current separation which, due to the high input speed of the material, is conditioned into a rapid sifting-gas flow of low width the flow velocity having to be so high that the material, in a flight time of the order of magnitude of 1/100 sec is fanned out enough so that it can be separated into fractions by the knife edges opposing the trajectories of the material. Separation takes place in free flight and is not affected by rebound of the material trajectories on a wall, except for the unavoidable rebound of a trajectory which exactly hits the separating limit at a knife.

In the cross-current method discussed in the foregoing, the entire sifting gas, entering the separating zone through a nozzle provided with flow straightener and possibly an annular additional nozzle and/or an annular additional gas inlet provided outside the nozzle, enters the flow duct and carries the fine material contained in the charged material along with it. The coarse material then flies through the sifting gas current over a knife edge situated on the side of the flow duct opposite the material inlet, and enters the coarse material collecting chamber or receptacle. In a further modification of the basic method the fine material separated by the outer knife edge at the flow duct edge and the flowing sifting gas are subsequently separated by a further knife edge arranged for example centrally in the flow duct, into two fractions and two partial currents. In this case, however, part of the material before separation rebounds on the side of the outer knife edge and can ebound over the central knife edge into the inner flow duct. To this extent, this subsequent separation does not come within the type of method discussed here. On the other hand, even in this modification, the direction of flow of both departing partial currents is the same as the direction of the arriving flow.

A particularly favourable effect of cross-current sifting of this type has been found to be that even in the case of large quantities of the charged material, it separates sharply, and above all separation is shifted to fine separation limits. Thus, it is possible in an axially-symmetrical cross-current sifter according to U.S. Pat. No. 3,520,407, in which the flow duct has an annular inlet for the sifting gas charged with fine material, in a separating zone of 30 cm internal diameter and 38 cm external diameter, i.e. about 4 cm radial extent — which corresponds to a path of flight of about 6cm in length — for 10 ton /h material input quantity, to attain a sharp separation at 9$\mu$ separating limit. For smaller quantities of material, very sharp separations are certainly possible, but the separation limit is much higher. It is characteristic of the known cross-current wind shifting method that separation is independent of charging only up to a certain charge rate of material, and the separation limit cannot be adjusted below a certain value. Thus in the axially-symmetrical cross-current wind sifter, which gave the 9$\mu$ separation limit at 10 ton/h, even under extreme conditions, namely above 70 m/sec material input velocity, only about 6 cm flight path (flying time below 1/1000 sec) and only 20 m/sec air velocity, the separation limit between coarse-material and fine material, in a range of operation which is independent of charge rate, cannot be reduced below 40$\mu$. Only by increasing the quantity of material beyond a certain limit, has it been possible to shift the separation limit to smaller particle sizes. At the same time, however, the separation sharpness is reduced; it is possible, however, to obtain still sufficiently sharp separations until the charge of material exceeds by more than ten times the limit of the charge-independent range.

The range of separation which is independent of charge rate is commercially very interesting because it permits sifting of large quantities of material, as well as very fine separation.

The problem underlying the present invention is to provide a method and device for cross-current sifting of particulate material at separation limits below 1 mm, in particular below 300$\mu$ down to a few $\mu$, in which separation is largely independent of the material charge-rate, and also, in the charge-rate independent stable separation range, permits much lower separation limits to be attained than heretofore, while at the same time ensuring the principal advantage of cross-current sifting of this type, i.e. of attaining a high sharpness of separation even for exceptionally high material charge rates of the sifting current and heavy throughputs.

SUMMARY OF THE INVENTION

This problem is solved according to the present invention with a cross-current sifting method of this general type in which a partial flow is led off in a direction differing from the influx direction of the sifting gas, the partial current having a momentum component in a direction opposite to the direction in which the material is propelled which is at least 1/10 of the momentum of the current of material being propelled into the sifting gas current for separation.

The primary advantage of the method according to the present invention is that the influence of the rate of charging can be minimized or compensatd by the partial stream which is drawn off. As noted above, this partial stream is drawn off in a direction which counteracts the effect of the momentum of the current of material being propelled into the sifting gas to be sifted on the sifting gas stream, i.e. it compensates for the deviation in the direction of the stream which results when large amounts of material are charged. As will be explained in more detail below, the partial gas flow is drawn off at a point which is preferably directly adjacent to the point at which the material is propelled into the sifting gas current. By exhausting the partial current, the tendency of the displacement of the separation limit, i.e., the cut-off size between the coarse fraction and fine fraction, for example, toward lower values with an increasing material load is counteracted. That is, the tendency for more fine material to be in the coarse fraction due to the effect on the sifting gas current is counteracted. The counteracting force is a function of the pressure difference, which in turn affects the rate of removal, the suction cross section, which has an effect on the quantity removed, and the direction of the exhaust, i.e., its component in a direction opposite the direction in which the material is propelled in the sifting gas current. Naturally, the greater the pressure and rate of removal, the greater the suction cross section, and the larger the component directly opposed to the charging direction, the greater will be the compensating effect. In an extreme case, the exhaust of the partial current takes place in a direction opposite to the material input direction being directed around the sharp turn having a radius which is no greater than the minimum required by the material charging device.

Through the control of the partial current, i.e. its quantity and speed and the direction of the partial current, the forces exchanged between the material to be sifted and the gas stream can be adjusted so that the shift in separation limit due to increasing amounts of material being propelled into the stream for sifting is compensated. In cases where a large proportion of very fine material must be sifted, the partial current drawn off must be made correspondingly large and in some cases more than 50%, i.e. its momentum may need to be more than 50% of the momentum of the current of inflowing material.

Using a small partial current suction with a small suction cross section, it is possible to adjust an extremely low separation limit of less than a few microns for the material which is drawn off. Also, the dimensions in the axially-symmetrical wind sifter, as known in principle from U.S. Pat. No. 3,520,407, may be so selected that even very large rates of charged material of between 10 and 100 tons per hour can be sifted.

The ability to sift such large quantities with very fine sifting being carried out has not previously been possible. In addition to its ability to carry out fine sifting, the cross-current method of the present invention, because of the high relative velocity between the input velocity and the velocity of removal by suction, causes the finer particles to deviate sharply from the path that they would normally follow and to become well dispersed.

The partial current which is drawn off by suction directly after the material charging point should be adjusted to result in a pressure drop in the sifting zone which maintains equilibrium with the force exerted on the flow transverse to the shifting gas flow direction. The velocity and quantity of the partial current which is drawn off should be adjusted in accordance with the pressure drop and the magnitude of removal through control of the suction opening even if the ratio of the momentum of the currents of material and sifting gas entering the separating zone at right angles to one another attains and exceeds an order of magnitude of 1/10 to 1.

It has been found that, even in the case of such high material current momentum, an adequate compensating force is exerted on the sifting gas flow when the component of the current momentum of the partial current directed opposite to the material charging direction is of the order of magnitude of between 1/10 and the total value of the material current magnitude at the draw off point.

The present invention provides a further important advantage in that a broader range of material sizes can be separated. This in turn permits two favorable effects to be obtained. First, it is possible to arrange the knife edge at a greater distance from the material charging point, i.e. to permit longer trajectories. Theoretically, in the case of longer trajectories and the same dispersion angle, the trajectory spacing will be greater and hence the separation at the knife edge will be sharper, because the knife edge must have a certain thickness and because the material particles of adjacent trajectories exert a mutual influence on each other. This mutual influence, which is due mainly to collisions between particles of the material, is obviously the cause of the separation sharpness diminishing with increasing material charge. All attempts to extend the trajectories between the material charging point and knife edge beyond 5 to 6 cm length for improving the separation sharpness at high loads have failed in the known cross-current mentioned hereinbefore. The increase in the length of the material trajectories to the knife edge from about 5 to 6 cm to 10 to 30 cm, made possible by the present invention for increasing the separation sharpness for a high material charge can be combined in axially-symmetrical cross-current sifters still having low separation limits if a rotational component is superimposed on the flow. Streamlines are then obtained where the flow does not pass through walls, i.e. where the coarse material emerges from the sifting gas current with an outwardly directed component. Since with superimposed current rotation, the power costs are increased, this step is not always advantageous.

The second and most important effect is that the present invention permits the utilization of a larger angular range over which the material being separated is spread. This range extends from the charging direction to the direction opposite thereto in which a component of the partial current is drawn off. In other words, heavier particles can have a path through the separating zone which is almost the same as the direction with which they are propelled into the zone. Very fine particles on the other hand will be acted upon in such a manner that their direction changes by almost 180°. Particles in between, of course, will be spread over the remainder of the range. To achieve this, it is advantageous to adjust to one another the partial current velocity component v opposed to the material inlet direction, the material inlet velocity w and the orifice width s — thickness of the partial current — (FIGS. 1*a* and 1*b*) of the partial current removal by suction directly after the material inlet, so that they satisfy approximately the minimum condition $$s.(v/w)^2 \geqq 1 \text{ mm.}$$

Thus, the sharpness of separation is increased and the separation range is widened, above all towards the fine separation limits. Even in very high material charges, each point of the total half-arc may be provided with a knife edge, so that any separation limit can be adjusted from slight to strong trajectory deflection. The invention thus permits, even in the case of high material charges, sharpness of separation and undisturbed division into a number of fractions.

For the supply flow of the sifting gas, there is available on the side of the sifting zone opposite the downflow between the knife edges a duct width of any desired size, which may be greater than the total discharge flow ducts, so that the flow on entering ducts is accelerated and is thereby stabilised.

The direction of sifting gas supply flow need not be the same at all points. The sifting gas flow may also be drawn in from the atmosphere. Its direction, however, must be fixed by a wall at the material inlet point. Relative to this supply flow direction at the material inlet point, in the case of the present invention, the direction of the partial current is inclined to the material inlet direction.

For stabilising the sifting gas current at its jet limit, which extends to the knife edge separating the coarse material from the next finer fraction, it may be advantageous to lead off a small portion of the sifting gas current with the coarse material. This portion should correspond approximately to the quantity of the gas current turbulently admixed at the jet limit, which quantity in most cases is much less than 10% of the sifting gas current. In many cases, especially in coarse sifting, this step, which requires additional expenditure, is not necessary.

It is important to prevent material rebounding at the walls of the flow ducts from rebounding into other ducts through which fine material is led off. This risk occurs particularly since, in the case of material particles rebounding off a wall, the law of equality of the angle of impact and angle of reflection is not always satisfied, but even in the case of oblique rebounding a steeper rebound of up to 90° may occur. Therefore, according to the invention, the knife-edges and walls limiting each material removal duct are so arranged that the material trajectories starting from the material input point and encountering the duct walls, as well as the material trajectories reflected there, are directed towards the interior of the duct. They therefore fly at the same angle of reflection within the duct provided for them. The arrangement and alignment in addition, however, should be so selected that even in the case of vertical rebound, the trajectories extend into the interior of the duct.

In the case of separation into two fractions, the present invention offers two possibilities. If the charged material contains no very fine material which is carried along with the partial current drawn off immediately after the material charging point, separation into fine material and coarse material is effected by a knife edge dividing the material trajectories outside the partial current, and the partial current has merely the function according to the present invention of improving this separation and particularly in the case of large material charges, of stabilizing it. If very fine material is present, it is possible by means of a knife edge also to effect a separation of this entrained material into two fractions. This is recommended if there is no requirement for a second coarser separation at the same time.

A special advantage of the method according to the present invention lies precisely in the fact that, together with the partial current, the finest material can be separated directly, the charged material being separated into at least three fractions, at least also one middle fraction, and at least also one coarse material fraction. The residual sifting gas is preferably carried off with the one or with each middle material fraction. Separation from the sifting gas is now possible completely or almost completely with simple separating devices, for example cyclones, because the middle material fraction no longer contains any very fine material. This mode of operation is particularly advantageous if the residual sifting gas, after separation of the middle material fraction is recirculated in the separating zone. This therefore avoids a serious drawback of all hitherto available whirlwind air sifters, including cyclone circulating-air sifters, the said drawback being due to the incomplete separation of the finest fractions from the circulated sifting gas. Cyclones, particularly large cyclones of the whirlwind air sifters, separate particles below 5$\mu$, also even below 10$\mu$ very incompletely. Still worse is the separation of fine and very fine material in whirlwind air sifters without cyclones. Consequently, the content of very fine material in the circuit increases. It was finally possible by fortuitous transport processes and by the fact the very fine material was washed out of the circulated sifting gas in no small amount into the coarse material. To this effect and not soley to the agglomeration of the very fine material is due the fact that the separation curve for large throughputs, only in the circulating air sifters under consideration, in the case of very fine particles — often already below 20 to 30 $\mu$ — rises again to large separation degrees, for example 25 to 50% separation of the very finest particle sizes in the coarse material. In the given modification of the method according to the invention, the very fine material is withdrawn from the circulating current. If it is to be separated from the partial current, suitable devices may be used for this purpose, for example bag filters. The partial current can also be returned afterwards, but in the case of complete dust removal this is not necessary. If it is not to be returned, a correspondingly large partial current will be supplied from outside the circuit. This has the further advantage that the velocity of this additionally supplied partial current can be adjusted according to the desired separation conditions, independently of those of the circulating current.

A further possible development of the invention is to introduce part of the arriving sifting gas, together with the material, into the separating zone. In the circulating air method, this can always be a freshly supplied part of the sifting gas current flowing to the sifting zone or part of the said part.

The possibility according to the invention of separation into more than two fractions may furthermore be used for re-supplying to the separating zone a middle material fraction after separation from a sifting gas partial current or also only from a part of this partial current. This middle material fraction is preferably introduced along with the charged material. The return of a fraction serves to increase the separation sharpness between its two neighbouring removed fractions in the particle size range of the returned fraction or of the increase in throughput for constant sharpness of separation.

The novelty and particular advantage of the method according to the present invention is that the middle fraction together with the two adjacent fractions can be separated in the same separating process at the same time as the two neighbouring fractions and that the separation limits confining the middle fraction and thus also the resultant separation occurring on return, for example by the knife edge adjustment, can be varied as desired. As shown by theoretical investigations, the return of the middle material fraction can only be advantageous in the material charging region, in which the decrease in sharpness of separation with increasing material charge is not too great. Since the method according to the present invention does diminish this dependence, the return of the middle material fraction here provides special advantages and permits of extremely high values of separation sharpness.

In all the applications of the method according to the present invention, the flow medium quantities can be adjusted differently. Furthermore, there are possibilities of variation in the position of the knife edges, in the size of the discharge and supply ducts, in the rate of input of the material and in the velocity of the sifting current.

In some cases it has been found advantageous to supply part of the sifting gas at a high velocity for disagglomerating the charged material and sifting the fine material immediately out of it. Then, preferably, correspondingly low velocities of flow from the initial direction are necessary, so that in the downstream ducts for the sifting air there is no flow detachment or backflow. Reaction of the material on the sifting gas flow may displace the velocity distribution in the downstream ducts and thereby favour backflow. Satisfactory and stable flow conditions in the sifting zone and the flow ducts may be adjusted by the sifting gas velocity on entering the partial current exhaust and the sifting gas velocity on entering the ducts, through which the middle material fractions are led off, being higher than the velocities of flow of the sifting gas into the separating zone, the flow being preferably effected through a single correspondingly large inlet flow duct.

For incorporating the cross-current sifter in continuous production plants and particularly in the case of irregular material supply, there generally arises the necessity of a control, the statement of the problem being to maintain constant the separation limit or to vary it in a prescribed manner with the material charging quantity. The invention offers the possibility of a particularly advantageous sifter control. For this purpose, the mass flow ratio of two fractions is measured and constantly adjusted or controlled, by correspondingly varying the partial current drawn off behind the material input point. If, for example, the mass flow of the charged sifting material becomes greater, the separation to be controlled is shifted towards fine. Then the quantity of partial current drawn off or its velocity must be increased, until the mass flow ratio assumes the original or a predetermined value. This can be made dependent on the absolute magnitude of a mass flow, because for example within the complex co-operation of the separating device with other units of the plant, for example a mill, it may be expedient, in the case of a varied mass flow of the material, to shift the separation limit of the sifter in a very definite direction. The measurement of the mass flows can be carried out in various ways, for example by on-line concentration measurement. Preferably, an momentum flow measurement will be used.

BRIEF DESCRIPTION OF THE DRAWINGS

FIG. 2 is a diagrammatic cross-section through a plane corss-current sifter with material charging by two superimposed conveyor belts, providing separation of the sifted material into a coarse material fraction, a middle material fraction and a fine material fraction.

FIG. 3 is a diagrammatic cross-section through a plane cross-current sifter with a pneumatic material infeed providing separation of the material into a coarse and a fine middle material fraction, as well as a fine material fraction.

DETAILED DESCRIPTION OF THE INVENTION

Figure 1A:
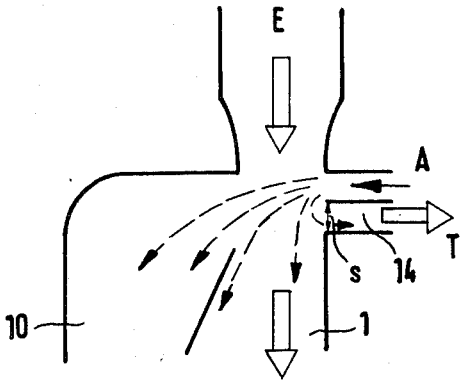
FIGS. 1*a* and 1*b* are diagrammatic representations of a plane cross-current sifter showing how the material charging direction A, intake direction E of the sifting gas and discharge direction of the partial current T may be situated with respect to one another.
Figure 1B:
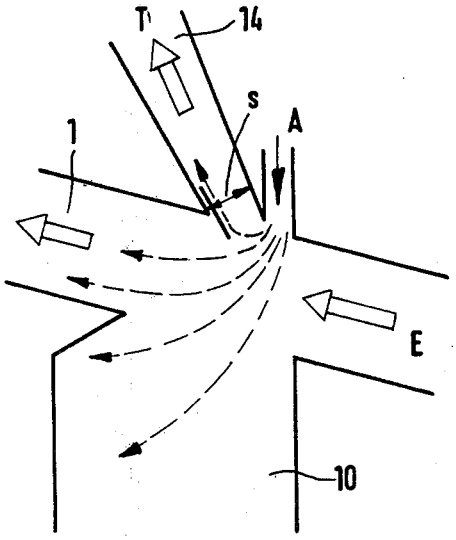

FIG. 1*a* and 1*b* show examples of how the material charging direction A, inflow direction E of the sifting gas and exhaust direction of the partial current T may be situated relative to each other. In these figures and the remaining figures the coarse material receptacle is designated 10, the duct for the partial flow 14 and the main flow duct 1.

The plane cross-current sifter according to FIG. 2 has a flow duct 1 for sifting gas charged with fine material, into the inlet opening of which duct a sifting gas current from a sifting as inlet nozzle 4, preceded by a flow straightener 5, enters a sifting zone 2. The material is charged into the sifting zone 2 transversely through an infeed device 3 in the form of a double conveyor belt. To a lower conveyor belt 6 is connected a conveyor belt 7, rotating at the same speed and overlaps or covers the material layer in front of the material dropping point. The material charging or dropping point 8 is situated in FIG. 2 on the right-hand side of the flow duct 1. Opposite it above the left-hand wall of the flow duct 1, the inlet of a coarse material collecting receptacle 10 is provided. Its walls are inclined to the inlet direction of the material or to the coarse material trajectories, such that rebounding of the coarse material particles into the sifting zone is impossible. The downstream edge of the inlet orifice of the coarse material collecting receptacle is bounded by a knife-edge 11 indicated diagrammatically, which opposes the material trajectories. Strictly speaking, a distinction should be made between the knife edge carrier 11*a* and the knife edge 11 which is situated at the edge of the knife edge carrier 11*a*. The fact that the knife edge 11 opposes the material trajectories does not necessarily mean that the knife edge carriers are arranged exactly in the direction of the material trajectories. Generally, the material trajectories impinge on the sides of the knife edge carriers at an acute angle. In the Figures, knife edge and knife edge carrier, for the sake of simplicity, are referred to simply as "knife edge" and provided with a numeral, e.g. 15. Directly downstream of the material inlet point 8 an inlet opening 13 of a suction duct 14 is provided, through which a partial current of the sifting gas current flowing from the nozzle 4 with a flow component opposed to the material charging direction can be drawn off by suction. The downstream edge of the inlet opening 13 has an adjustable knife edge 15, by means of which the size of the inlet opening can be varied. The rest of the sifting gas quantity, not drawn off through the suction duct 14, flows into the sifting gas duct 1. The adjustable knife edge 15 separates the fine material carried off with the partial current T from the middle material, which is led off by the sifting gas in the flow duct 1. The knife edge 11 separates the middle material from the coarse material which flies into the coarse material collecting receptacle 10. All the walls of the ducts and containers receiving the material are so arranged that the impinging material trajectories are directed into the interior of the associated ducts and also the particles rebounding vertically, when they reach the opposite wall, are directed obliquely inward. The medium material is at the same time deflected from the flow into the interior of the duct. The partial current drawn off through the suction duct 14, can be adjusted in the case of coarser charged material such that no fine material is carried along. The sifter then separates into two fractions only. Even with a comparatively high throughput, very sharp separations are possible between coarse material and middle material, and between middle material and fine material very low separation limits with very good separation sharpness are possible. The cross-current sifter according to FIG. 2, except for the suction duct 14 opening directly downstream of the material input point 8, corresponds substantially to the plane cross-current sifter disclosed in U.S. Pat. No. 3,311,234.

FIG. 3 shows an example of a plane cross-current sifter with pneumatic material charging device. The material is fed by a pneumatic charging device 20 into the sifting zone. Through the latter, the material particles are accelerated pneumatically to the input speed and are again charged through the material input 8 into the sifting zone 2. The pneumatic charging device has a material feed hopper 22 opening into the charging duct 21 and an injector nozzle 23 opening co-axially to the duct 21 below the outlet of the hopper 22. Directly followng the material charging point, the partial current T is drawn off over a rounded edge 25 through the inlet opening 13. The rest of the sifting gas current issuing from the nozzle 4 into the sifting zone 2 is divided into two further partial currents by means of a middle wall 27 provided with an adjustable knife edge 26, so that the sifting gas duct 1 forms two middle material ducts 28 and 29. The three knife edges 15, 26 and 11 separate fine material from the fine middle material fraction, which is led off through the duct 28, the middle material fraction from the coarser middle material fraction, led off through the middle material duct 29, and the latter from the coarse material which flies away over the knife edge 11 into the coarse material collecting receptacle 10. In order, for example, to obtain a particularly sharp separation of the fine middle material fraction from coarse material, the coarse middle material fraction, after separation from the sifting gas or also together with a suitable sifting gas quantity through the duct 21 of the pneumatic charging device 20, may be mixed with the charge material and together with the latter may be charged at the charging point 8 into the sifting zone 2. Correspondngly, the fine middle material fraction may be returned for effecting a particularly sharp separation between fine material and coarse middle material fractions. The advantageous construction of the knife edges in all applications of the invention depends on the effect of wear caused by the impinging material. In the case of soft material, the knife edges are preferably made pointed as shown in FIG. 3, in the case of hard, strongly abrasive materials, somewhat rounded knife edges of particularly wear resistant material are used. In the case of rounded knife edges, the return of a fraction offers special advantages.

Figure 4:
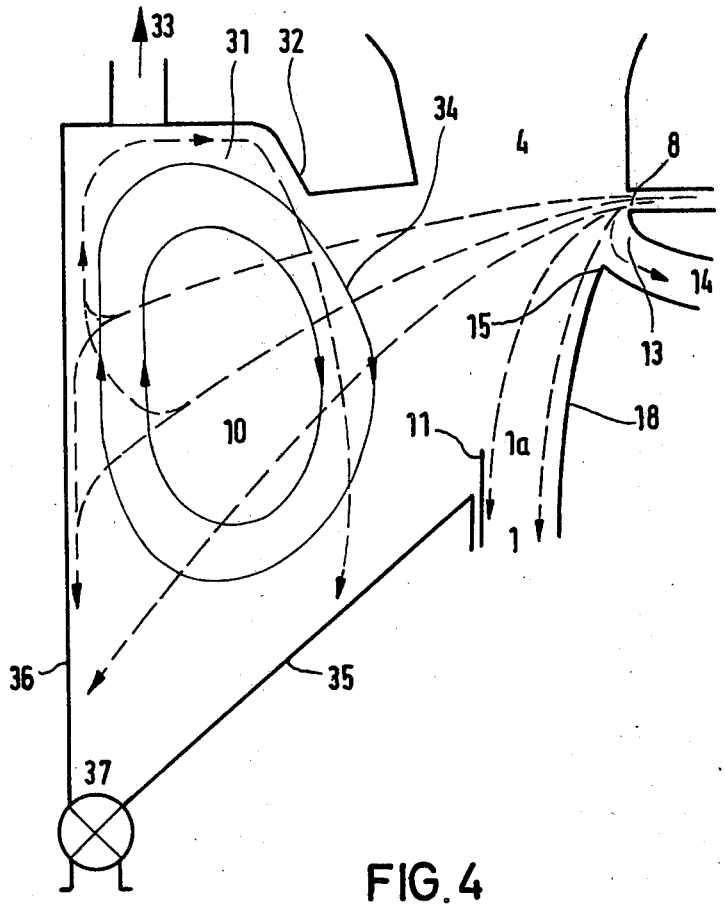
FIG. 4 is a diagrammatic cross-section through a plane cross-currrent sifter with a construction of the coarse material collecting receptacle deflecting the coarse material downward.

FIG. 4 shows another modification of a plane sifter which has proved satisfactory in avoiding sprayed particles in the middle material fraction or each such fraction. It may, however, be used in the same way in the axially-symmetrical sifter. Also, the material supply can take place in any manner, for example by means of a conveyor belt or pneumatically or with a scatter plate. The coarse material collecting receptacle 10 has in the upper part a depression 31 with a preferably oblique or even vertical wall 32 on the separating zone side. If, in the coarse material ascent space, a secondary flow 34 is formed which is strong enough to take the coarse material particles along with it, the latter are deflected downwardly by the oblique wall 32 and pass again onto the bottom wall 35 and the outer wall 36 and into the collecting hopper 37 of the coarse material collecting receptacles. The effect of secondary flow in the coarse material collecting space may be reduced considerably and the flow from the supply duct or the sifting gas inlet nozzle 4 to the sifting gas duct or flow duct 1 may be stabilised if a partial air current is drawn off through the outlet 33 in the cover of the coarse material collecting receptacle 10. FIG. 4 also shows a mode of guiding of the flow according to the present invention, in which the cross-sections at the inlet point 1*a* into the flow duct 1 and at the inlet point 13 to the suction duct 14 for drawing off the sifting gas are together smaller than the outlet opening of the sifting gas inlet nozzle 4. Accelerated stable flow therefore prevails in the sifting zone at all points, so that even in the event of displacements due to the influence of the material, no disturbing backflows are initiated.

The wall 18 between the adjustable knife edge 15 and the flow duct 1 extends obliquely or is preferably curved corresponding to the curvature of the material trajectories. A particularly advantageous position of the knife edge 15 is thereby made possible.

Figure 5:
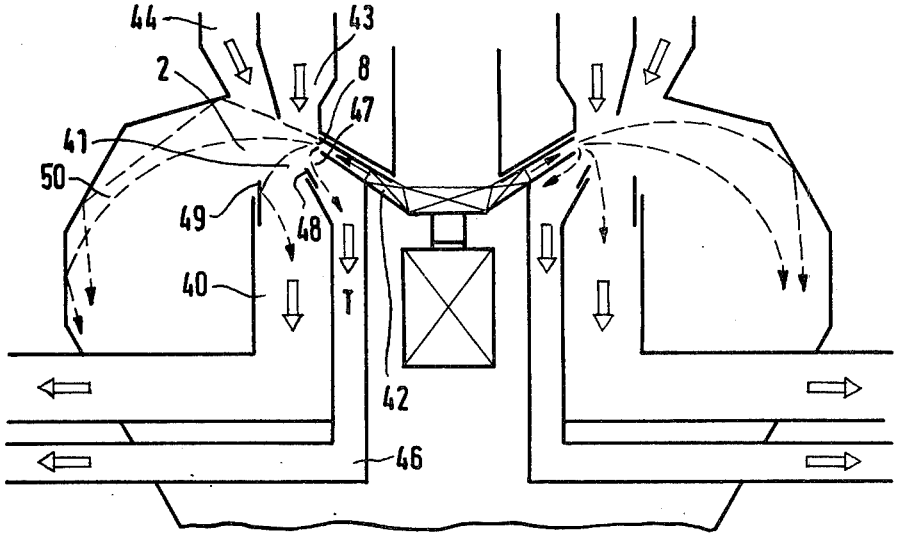
FIG. 5 is a diagrammatic cross section of a rotationally symmetrical cross-current sifter with sifting gas flowing through two flow ducts into the sifting zone, and separation of the sifted material into three fractions.
Figure 6:
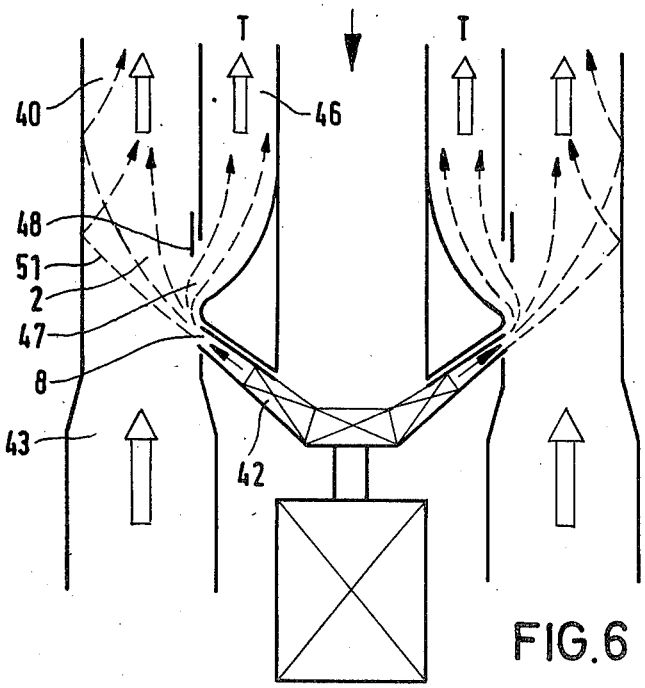
FIG. 6 is a diagrammatic cross section of an axially-symmetrical cross-current sifter with a sifting gas flow directed from below upward and separation of the sifted material into two fractions.

FIGS. 5 and 6 show two axially-symmetrical cross-current wind sifters. These sifters correspond in their fundamental construction essentially to those according to U.S. Pat. No. 3,520,407. The cross-current sifter shown has a fixed elongated cylindrical flow duct 40 for sifting gas charged with fine material. Coaxially with the annular inlet opening 41 of the flow duct 40 is a centrifugal plate 42, driven from below by a variable speed motor, the wall of which plate coming into contact with the sifted material has in the outer region a concave-conical surface of revolution and is covered at a slight spacing by a cover extending to the outer edge of the plate. The external diameter of the centrifugal plate is not larger than the internal diameter of the flow duct 40. This is not a necessary condition of the invention. Above all, however, it is generally expedient for assembly reasons. Coaxially preceding the centrifugal plate 42 and the flow duct 40 with an axial spacing is an annular sifting gas nozzle 43, tapering in the flow direction towards the inlet. This nozzle is surrounded coaxially by a second nozzle 44. The two nozzles 43 and 44 form two sifting gas supply ducts through which the sifting gas flows from above into the sifting zone 2. Adjoining the flow duct 40 on the inside is a suction duct 46 of annular cross-section and having its inlet orifice 47 opening directly below the annular material charging point 8. The downstream inlet edge of the suction duct 46 has again a knife edge 48. A second knife edge 49 is provided on the outer inlet edge of the flow duct 40 for varying the separation limit with respect to the coarse material. The latter passes over the upper edge of the knife edge 49 into an axially symmetrical coarse material collecting receptacle 50, surrounding the flow duct 40 and having its walls sloping such that no coarse material can rebound into the sifting zone. Downstream, directly following the material input point 8, there is drawn off through the inlet of the suction duct 46 a partial current of the sifting gas current entering the sifting gas zone 2 from above in the opposite direction to the material input direction. The rest of the sifting gas flows away into the flow duct 40. By means of the knife edges 48 and 49, the material spread out in the sifting zone by the sifting gas is separated into three fractions. The coarse material is collected in the coarse material collecting receptacle 50 and is drawn off from it either by means of a sluice or a partial air current. In the case of drawing off by sluice a secondary flow obviously prevails in the coarse material space initiated by the movement of the material, the velocity of which secondary flow, however, especially in coarser separations, can be kept so small in the large space that no coarse material can thereby find its way into the middle material.

In the embodiment of an axially symmetrical cross-current sifter, through which flow takes place from below upwardly, as shown in FIG. 6, the material to be sifted, charged centrally from above, is carried by the centrifugal plate throgh the charging point 8 into the sifting zone 2 and is separated into two fractions solely by the suction of the partial current T through the inlet 47 of the inner suction duct 46 and by the knife edge 48. The rest of the sifting gas flows away in the same direction as the oncoming sifting gas into the flow duct 40. The knife edge 48 is situated still upstream of the point of impact of the lowest material trajectory 51, so that even in the case of a vertical rebound no coarse material can pass through the inlet opening 47 of the suction duct 46 into the latter.

Figure 7:
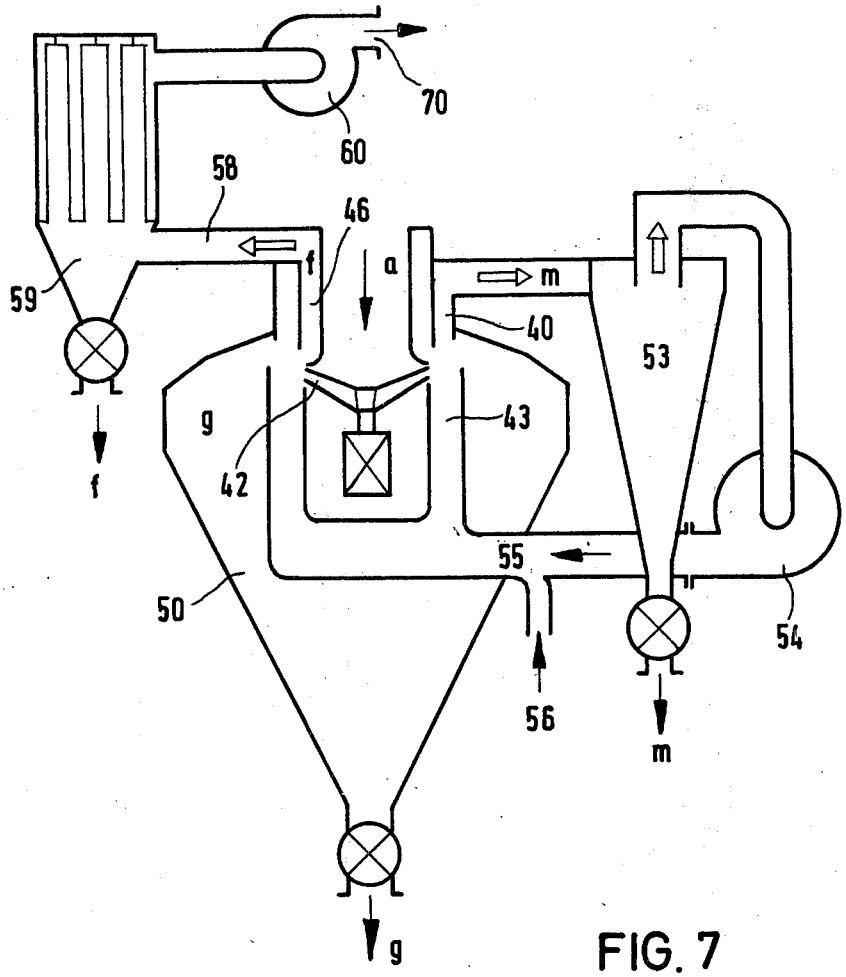
FIG. 7 is a diagrammatic cross section of an axially symmetrical cross-current sifter in with sifting gas circulation.

FIG. 7 shows an example of a particularly advantageous cross-current sifting plant with circulation of part of the sifting gas. The charged material a is separated into a fine material f, drawn off with the partial current through the suction duct 46, a middle material m issuing with the rest of the sifting gas from the flow duct 40 and a coarse material g entering the coarse material collecting container 50. The middle material is carried out of the separating zone by the rest of the sifting gas current issuing from the nozzle 43 and is separated in a cyclone 53 connected to the flow duct 40. The purified sifting gas is drawn off centrally from the cyclone 53 by means of a blower 54 and returns to the nozzle 43. At one point 53 fresh sifting as is fed through an inlet pipe 56 into the sifting gas circuit in an amount corresponding to the partial current amount drawn off through the suction duct 46. The fine material fraction led off with the partial current at 46 is advantageously supplied through a conduit 58 to a filter, for example a bag filter 59, where it is separated. The partial current quantity of the sifting gas is drawn off by a fan 60, which provides sufficient pressure drop for suction removal and separation of the fine material. Removal of the coarse material from the coarse-material collecting receptacle 50 is effected by a bucket wheel lock or sluice.

What is claimed is:

1. In apparatus for sifting particulate material in a cross-current comprising:

(a) a flow duct for material charged sifting gas having an inlet opening and a material charging opening essentially perpendicular thereto;

(b) means supplying a sifting gas current at high velocity to said inlet opening;

(c) means for propelling material to be separated to a charging point at said charging opening in said duct and into said sifting zone, said means arranged to propel said material transversely with respect to the sifting gas current;

(d) at least one knife edge pointed so as to oppose the trajectory of the material propelled into said sifting zone;

(e) a coarse material collecting receptacle on the side of said knife edge opposite the material charging point; and (f) a discharge duct on the other side of said knife edge, wherein the improvement comprises:

(g) an additional discharge duct having an inlet opening into said sifting zone duct down stream of the material charging point and immediately therebehind for drawing a partial current of the entering sifting gas therethrough, said duct extending primarily in a direction opposite said material input direction such as to have its current component with a direction opposite the material input direction.

2. Apparatus according to claim 1 and further including an adjustable knife edge blade disposed at said additional discharge duct inlet opening.

3. Apparatus according to claim 1 wherein said sifting flow duct is of a rectangular construction and wherein said means for propelling said material into said sifting gas comprises a conveyor belt and further including means rotating at the same speed as said conveyor belt disposed thereabove at the material charging point.

4. Apparatus according to claim 3 wherein said means rotating comprise and additional conveyor belt.

5. Apparatus according to claim 3 wherein said means rotating comprise a roller.

6. Apparatus according to claim 1 wherein said means for charging material into said sifting zone comprise a pneumatic charging device.

7. Apparatus according to claim 1 wherein said sifting zone duct is a symmetrical flow duct having an annular inlet opening and wherein said means for charging material into said sifting zone comprise a centrifugal plate coaxial with said inlet opening, said plate having an external diameter which is not larger than the internal diameter of said flow duct.

8. Apparatus according to claim 7 wherein said centrifugal plate has a wall which is contacted by the material to be sifted in the form of a concave curved rotational surface at least in its outer radial region and further including a cover extending a least slight distance to the outer edge of said plate.

9. Apparatus according to claim 1 and further including a top depression associated with said coarse material collecting receptacle and an obliquely downward directed wall associated therewith to cause material carried upwardly by a rotating secondary gas current to be returned into the coarse material collecting receptacle.

10. Apparatus according to claim 1 wherein said knife edge and adjustable knife edge blade and the walls defining said coarse material receptacle, said flow duct and said discharge duct are inclined toward the trajectories such that material trajectories encountering said knife edges and walls along with any reflecged trajectories therefrom are always directed into the interior of said receptacle and ducts even in the case of a vertical rebound.

11. In a method for sifting particulate material in a cross current comprising the steps of:

(a) establishing a high velocity sifting gas current;

(b) propelling the particles to be sifted into the sifting gas current at a separating zone with all the particles of the same size having the same velocity of at least approximately 5m/sec at a material charging point in a thin layer transverse to the direction of the sifting gas current whereby said particles will be spread out according to size based on their individual momentum and the current of the sifting gas;

(c) after a time of flight of the order of magnitude of 1/100 sec. separating the spread out particles into at least two fractions using one or more knife edges pointing in a direction opposite to the trajectories of the material, and separation being carried out without any material previously rebounding from any wall; and (d) subdividing the incoming sifting gas current into at least two parts and leading off said parts separately, the improvement comprising:

(e) drawing off a partial current directly after the material charging point in a direction different from the influx direction of the sifting gas current said partial current having a current momentum component in a direction opposite to the direction in which the material is propelled into the sifting gas current which has a value which is at least 1/10 of that of the momentum of the momentum of the current of material being propelled into the sifting gas, whereby said partial current will have a stabilizing effect on the separation with varying throughputs of the material.

12. The method according to claim 11 wherein the at least two fractions include a coarse fraction and a middle fraction and wherein a finest fraction is carried off by said partial current.

13. The method according to claim 11 and further including the step of introducing a portion of the oncoming sifting gas along with said material into the separating zone.

14. The method according to claim 11 wherein said sifting gas current is rotationally symmetric and further including the step of providing said sifting gas current with a rotational component.

15. The method according to claim 11 wherein one of the fractions into which the incoming sifting gas current is subdivided carries therewith a middle fraction of the material being separated and wherein said fraction is at least partially recharged into the sifting zone at least partially with the material to be sifted.

16. The method according to claim 11 wherein one of said parts which are led off separately is led off with the coarse material and wherein said part is a small part of less than 10% of the incoming sifting gas current.

17. The method according to claim 11 and further including the step of varying the quantity of sifting gas partial current drawn off as a function of the mass current of the charged material such that the mass current ratio of the two fractions of material one remains constant or assumes a predetermined value dependent on the absolute valve of the mass current so as to control the action in the separating zone.

18. In a method for sifting particulate material in a cross current comprising the steps of:

(a) establishing a high velocity sifting gas current;

(b) propelling the particles to be sifted into the sifting gas current at a separating zone with all the particles of the same size having the same velocity of at least approximately 5m/sec at a material charging point in a thin layer transverse to the direction of the sifting gas current whereby said particles will spread out according to size based on their individual momentum and the current of the sifting gas;

(c) after a time of flight of the order of magnitude of 1/100 sec. separating the spread out particles into at least two fractions using one or more knife edges pointing in a direction opposite to the trajectories of the material, said separation being carried out without any material previously rebounding from any wall; and (d) subidviding the incoming sifting gas current into at least two parts and leading off said parts separately, the improvement comprising:

(e) drawing off a partial current directly after the material charging point in a direction different from the influx direction of the sifting gas current said partial current having a current momentum in a directin opposite to the direction in which the material is propelled into the sifting gas current which has a value which is of the same order of magnitude as the momentum of the current of material being propelled into the sifting gas.

19. In a method for siftingg particulate material in a cross current comprising the steps of:

(a) establishing a high velocity sifting gas current;

(b) propelling the particles to be sifted into the sifting gas current at a separating zone with all the particles of the same size having the same velocity of at least approximately 5m/sec at a material charging point in a thin layer transverse to the direction of the sifting gas current whereby said particles will spread out according to size based on their individual momentum and the current of the sifting gas;

(c) after a time of flight of the order of magnitude of 1/100 sec. separating the spread out particles into at least two fractions using one or more knife edges pointing in a direction opposite to the trajectories of the material, said separation being carried out without any material previously rebounding from any wall; and (d) subdividing the incoming sifting gas current into at least two parts and leading off said parts separately, the improvement comrising:

(e) drawing off a partial current directly after the material chrging point in a direction different from the influx direction of the sifting gas current said partial current having a current momentum component in a direction opposite to the direction in which the material is propelled into the sifting gas current which has a value which is at least 1/10 of that of sifting gas; and (f) adjusting the partial current velocity component v which is in a direction opposite to the material input direct, the material input velocity w and the aperture width s of the partial current which is drawn off so as to approximately satisfy the condition.

$$s. v/w \geqq 1 \text{ mm.}$$

20. In a method for sifting particulate material in a cross current comprising the steps of:

(a) establishing a high velocity sifting gas current;

(b) propelling the particles to be sifted into the sifting gas current at a separating zone with all the particles of the same size having the same velocity of at least approximately 5 m/sec at a material charging point in a thin layer transverse to the direction of the sifting gas current whereby said particles will spread out according to size based on their individual momentum and the current of the sifting gas;

(c) after a time of flight of the order of magnitude of 1/100 sec. separating the spread out particles into at least two fractions using one or more knife edges pointing in a direction opposite to the trajectories of the material, said separation being carried out without any material previously rebounding from any wall; and (d) subdividing the incoming sifting gas current into at least two parts including a coarse fraction and a middle fraction and leading off said parts separately, the improvement comprising:

(e) drawing off a partial current directly after the material charging point in a direction different from the influx direction of the sifting gas current, said partial current having a current momentum component in a direction opposite to the direction in which the material is propelled into the sifting gas current which has a value which is at least 1/10 of that of the momentum of the current of material being propelled into the sifting gas and carrying with said current a finest fraction; and (f) returning the portion of the sifting gas which is not drawn off as a partial current but which carries said middle fraction, after separation of said middle fraction, back to the incoming sifting gas.

21. In a method for sifting particulate material in a cross current comprising the steps of:

(a) establishing a high velocity sifting gas current through a single influx duct to form a sifting gas current;

(b) propelling the particles to be sifted into the sifting gas current at a separating zone with all the particles of the same size having the same velocity of at least approximately 5m/sec at a material charging point in a thin layer transverse to the direction of the sifting gas current whereby said particles will spread out according to size based on their individual momentum and the current of the sifting gas;

(c) after a time of flight of the order of magnitude of 1/100 sec. separating the spread out particles into at least two fractions using one or more knife edges pointing in a direction opposite to the trajectories of the material, said separation being carried out without any material previously rebounding from any wall;

(d) subdividing the incoming sifting gas current into at least two parts and leading off said parts separately, the improvement comprising:

(e) drawing off a partial current directly after the material charging point in a direction different from the influx direction of the sifting gas current said partial current having a current momentum component in a direction opposite to the direction in which the material is propelled into the sifting gas current which the material is propelled into the sifting gas current which has a value which is at least 1/10 of that of the momentum of the current of material being propelled into the sifting gas; and (f) adjusting the velocity of the portion of the sifting gas which is drawn off as a partial current and the velocity of the sifting gas which is lead off separately in separate parts to be greater than the velocity of the sifting gas entering into the separating zone.

* * * * *

UNITED STATES PATENT AND TRADEMARK OFFICE

CERTIFICATE OF CORRECTION

PATENT NO. : 4 132 634

DATED : January 2, 1979

INVENTOR(S) : Hans Rumpf et al

It is certified that error appears in the above-identified patent and that said Letters Patent are hereby corrected as shown below:

Column 1, lines 17-21, delete "as known... and 1 607 656."

Column 2, line 1, after "situated" insert --opposite the--

Column 2, lines 55-56, change equation to read:

-- Material particle diameter 10 30 50 100 300 >300μ --
Distance of fall in 1/100 sec. 0.03 0.2 0.33 0.43 0.5 0.5 mm Column 2, line 68, change first "the" to read --by--

Column 3, line 22, change "equlibrium" to --equilibrium--

Column 3, line 37, change "In this, method" to read --In this method, --

Column 3, line 46, change "decending" to --descending--

Column 3, line 51, change "centerflow" to --counterflow--

Column 3, line 57, after "width" insert --,--

UNITED STATES PATENT AND TRADEMARK OFFICE

CERTIFICATE OF CORRECTION

PATENT NO. : 4 132 634

DATED : January 2, 1979

INVENTOR(S) : Hans Rumpf et al

It is certified that error appears in the above-identified patent and that said Letters Patent are hereby corrected as shown below:

Column 3, line 65, after "knife" insert --edge--

Column 4, line 16, change "ebound" to --rebound--

Column 5, line 17, change "compensatd" to --compensated--

Column 7, line 31, after "entering" insert --these--

Column 9, line 44, change "low" to --high--

Column 10, line 24,change "corss-current" to --cross-current--

Column 10, line 34,change "cross-currrent" to --cross-current--

Column 10, line 61,change "as" to --gas--

Column 11, line 68,change "followng" to --following--

Column 12, line 22,change "Correspondngly" to --Correspondingly--

Column 13, line 60,change "throgh" to --through--

UNITED STATES PATENT AND TRADEMARK OFFICE

CERTIFICATE OF CORRECTION

PATENT NO. : 4 132 634

DATED : January 2, 1979

INVENTOR(S) : Hans Rumpf et al

It is certified that error appears in the above-identified patent and that said Letters Patent are hereby corrected as shown below:

Column 14, line 16, change "as" to --gas--

Column 15, line 30, change "reflecged" to --reflected--

Column 15, line 50, change "and" to --said--

Column 16, line 29, change "valve" to --value--

Column 16, line 49, change "subidviding" to --subdividing --

Column 16, line 56, change "directin" to --direction--

Column 16. line 61, change "siftingg" to --sifting--

Column 17, line 13, change "comrising" to --comprising--

Column 17, line 15, change "chrging" to --charging--

UNITED STATES PATENT AND TRADEMARK OFFICE

CERTIFICATE OF CORRECTION

PATENT NO. : 4 132 634

DATED : January 2, 1979

INVENTOR(S) : Hans Rumpf et al

It is certified that error appears in the above-identified patent and that said Letters Patent are hereby corrected as shown below:

Column 17, line 21, after "of" insert --the momentum of the current of material being propelled into the--

Column 18, lines 42-43, after "current" delete --which the material is propelled into the sifting gas current--

Signed and Sealed this

*Twenty-first* Day of *August 1979*

[SEAL]

*Attest:*

*Attesting Officer*

LUTRELLE F. PARKER

*Acting Commissioner of Patents and Trademarks*